United States Patent [19]

Thomas et al.

[11] Patent Number: 5,071,477

[45] Date of Patent: Dec. 10, 1991

[54] PROCESS FOR RECOVERY OF GOLD FROM REFRACTORY ORES

[75] Inventors: Kenneth G. Thomas, Mississauga, Canada; Herman J. Pieterse; Robert E. Brewer, both of Elko, Nev.; Kevin S. Fraser, Milton, Canada

[73] Assignee: American Barrick Resources Corporaiton of Toronto, Ontario, Canada

[21] Appl. No.: 518,125

[22] Filed: May 3, 1990

[51] Int. Cl.[5] ..... C22B 3/44

[52] U.S. Cl. ..... 75/744; 423/29

[58] Field of Search ..... 75/744; 423/29, 30, 423/31

[56] References Cited

U.S. PATENT DOCUMENTS

| | | | |
|---|---|---|---|
| 4,571,264 | 2/1986 | Weir et al. | 75/744 |
| 4,605,439 | 8/1986 | Weir | 75/744 |
| 4,979,987 | 12/1990 | Mason et al. | 423/30 |

*Primary Examiner*—Melvin J. Andrews

*Attorney, Agent, or Firm*—Senniger, Powers, Leavitt & Roedel

[57] ABSTRACT

The present invention is directed to an improvement in a process for the recovery of gold from refractory sulfidic auriferous ores which comprises oxidizing a slurry of ore with oxygen gas under pressure in the presence of sulfuric acid, neutralizing the oxidized slurry, cyanidizing the neutralized slurry to leach gold therefrom, and recovering gold from the resultant leachate. In accordance with the improved process, the oxidation of the ore slurry is carried out in a manner whereby, after a startup phase during which oxidation is initiated, the amount of sulfuric acid added to the ore slurry is sufficient to insure the oxidation of that portion of the sulfide sulfur in the ore which will allow recovery, by cyanide leaching, of at least about 80% of the gold in the ore. The oxidized slurry can be neutralized without a washing operation.

15 Claims, 6 Drawing Sheets

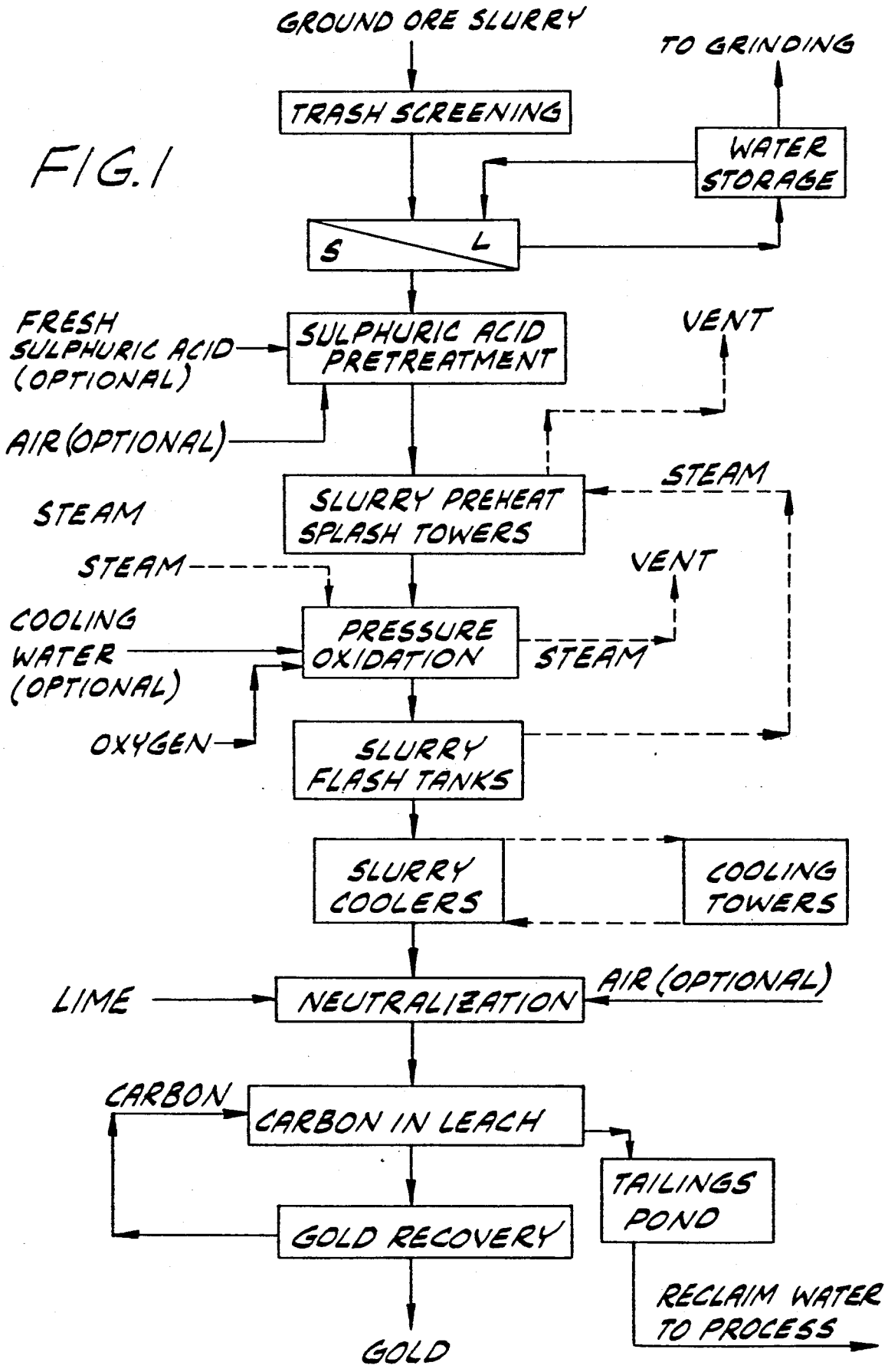
FIG. 1
GROUND ORE SLURRY
TO GRINDING
TRASH SCREENING
WATER STORAGE
S
L
FRESH SULPHURIC ACID (OPTIONAL)
SULPHURIC ACID PRETREATMENT
VENT
AIR (OPTIONAL)
STEAM
SLURRY PREHEAT SPLASH TOWERS
STEAM
STEAM
VENT
COOLING WATER (OPTIONAL)
PRESSURE OXIDATION
STEAM
OXYGEN
SLURRY FLASH TANKS
SLURRY COOLERS
COOLING TOWERS
LIME
NEUTRALIZATION
AIR (OPTIONAL)
CARBON
CARBON IN LEACH
TAILINGS POND
GOLD RECOVERY
RECLAIM WATER TO PROCESS
GOLD

CIL TAILINGS ASSAY AS A FUNCTION OF RESIDUAL SULFIDE SULFUR BETZE ORE

SULFIDE SULFUR OXIDATION
AS A FUNCTION OF TIME
BETZE ORE

PROCESS FOR RECOVERY OF GOLD FROM REFRACTORY ORES

BACKGROUND OF THE INVENTION

This invention relates to the recovery of gold from ores and, more particularly to an improved pressure oxidation process for the recovery of gold from refractory ores.

In order to remove sulfide sulfur, refractory ores are conventionally treated by pressure oxidation before cyanide leaching. If the sulfide sulfur is not substantially oxidized, leaching is inhibited and gold remains locked in the sulfides. By treating the ore in an aqueous slurry at elevated temperature and oxygen pressure, the sulfur is oxidized and removed from the ore before it is contacted with cyanide leaching agent. Thereafter the gold is leached by the cyanide and acceptable yields are produced.

Pressure oxidation is an exothermic process but requires the use of a substantial amount of energy in preheating the ore slurry to a temperature at which the reaction is self-sustaining. The oxidized slurry may contain substantial amounts of iron, arsenic and other heavy metals which it is desirable to remove before cyanidation. These various metals are typically oxidized during the pressure oxidation step, but further measures are required if the salts and oxides of these undesired metals are to be removed from the process.

Weir et al U.S. Pat. No. 4,571,263 describes a process for pressure oxidation of refractory ores in which the effluent from the pressure oxidation autoclave is subjected to a two step repulping operation with solids-liquid separations after each step. Liquid from the second separation step is recycled to the first repulping step. Liquid from the first separation step is in part recycled to pressure oxidation and in part subjected to a two step precipitation first with limestone and then with lime. Effluent slurry from the second precipitation step is subjected to solids-liquid separation and the liquid fraction is passed through a cooling pond and recycled to the second repulping step and the pressure oxidation step.

Weir U.S. Pat. No. 4,571,264 describes a pressure oxidation gold recovery process in which the effluent from the pressure oxidation step is repulped, thickened and then subjected to a two stage washing process. Water for washing derives from a liquid fraction produced in thickening the ore slurry after acid pretreatment prior to pressure oxidation. This liquid fraction is subjected to a two stage precipitation with limestone and lime, respectively. The effluent slurry from the second precipitation is thickened, and the liquid overflow from the latter thickener is used as water in the second washing stage. A solids-liquid separation after the second washing stage produces a liquid fraction which is recycled and serves as the wash water in the first washing stage.

In both Weir et al '263 and Weir et al '264, the neutralized oxidized slurry is subjected to cyanidation, followed by an eight stage carbon-in-leach absorption process. Both patents disclose pressure oxidation at 160° to 200° C. and 700–5000 kPa (total pressure).

Weir U.S. Pat. No. 4,606,763 describes pressure oxidation at 165° C. and 50–2000 kPa total pressure, using a compartment autoclave in which the first compartment is approximately twice the size of each of the other compartments. Weir U.S. Pat. No. 4,605,439 discloses a pressure oxidation process operated at 120° to 250° C. and 350–6000 kPa. Mason et al U.S. Pat. No. 4,552,589 discloses alkaline pressure oxidation at 220°–250° C. and 10–25 psia oxygen partial pressure for 30 to 90 minutes. Matson et al U.S. Pat. No. 4,289,532 describes alkaline pressure oxidation at 140°–190° F. using air.

SUMMARY OF THE INVENTION

Among the several objects of the present invention may be noted the provision of an improved and simplified process for the recovery of gold from refractory ores; the provision of such a process which effectively removes sulfur, iron, arsenic, and other heavy metals; the provision of such a process which is effective for the removal of oxides, salts and any other oxidation products of iron, arsenic and other heavy metals; the provision of such a process which can be implemented at relatively modest capital investment; the provision of such a process in which the consumption of sulfuric acid and lime or other neutralizing agent is significantly reduced; the provision of such a process which is energy efficient; the provision of such a process in which the volume of materials processed is reduced; and the provision of such a process by which gold is recovered in high yield from relatively lean refractory ores.

Briefly, therefore, the present invention is directed to an improved process for the recovery of gold from refractory sulfidic auriferous ores which comprises oxidizing a slurry of the ore with oxygen gas under pressure in the presence of sulfuric acid, neutralizing the oxidized slurry, cyanidizing the neutralized slurry to leach gold therefrom, and recovering gold from the resultant leachate. In accordance with the improved process the oxidation of the ore slurry is carried out in a manner whereby, after a startup phase during which oxidation is initiated, the amount of sulfuric acid added to the ore slurry is sufficient to insure the oxidation of that portion of the sulfide sulfur in the ore which will allow recovery, by cyanide leaching, of at least about 80%, preferably 90% of the gold in the ore. Preferably, the amount of sulfuric acid added after the initiation of oxidation is $\leqq$50% of the stoichiometric equivalent of the natural carbonate in the ore. An additional improvement is the neutralization of the oxidized slurry without passing through a washing operation. For the purposes herein, omission of a washing operation prior to the neutralization step is sometimes referred to as direct neutralization, which is meant to exclude a washing step between the oxidation step and neutralization step but does not exclude the interjection of other processing steps, for example a heat exchange step, in order to recover the sensible heat contained in the slurry exiting the oxidation step.

The invention is further directed to an improvement in the aforesaid process in which an auriferous ore slurry having a solids content of at least about 30% by weight is subjected to pressure oxidation in the presence of sulfuric acid in an autoclave at a temperature of between about 180° and about 225° C., a total pressure of between about 275 and about 490 psia, and an oxygen partial pressure of at least about 25 psia for a period of at least 60 minutes. After oxidation has been initiated, the oxidation reaction is conducted so as to oxidize that portion of the sulfide sulfur in the ore which will allow recovery, by cyanide leaching, of at least about 80%, more preferably about 90–95%, of the gold in the ore.

The oxidized slurry is then cooled, directly neutralized with lime and/or other base and the gold recovered by CIL (carbon-in-leach) processing. As a result of the improved process CIL tailings assaying 0.02 oz. of gold/ton or less can be achieved.

Other objects and features will be in part apparent and in part pointed out hereinafter.

BRIEF DESCRIPTION OF THE DRAWINGS

FIG. 1 is a flowsheet of a particular embodiment of the process of the invention;

Corresponding reference characters indicate corresponding process and equipment features in the several drawings.

DESCRIPTION OF THE PREFERRED EMBODIMENTS

Figure 2:
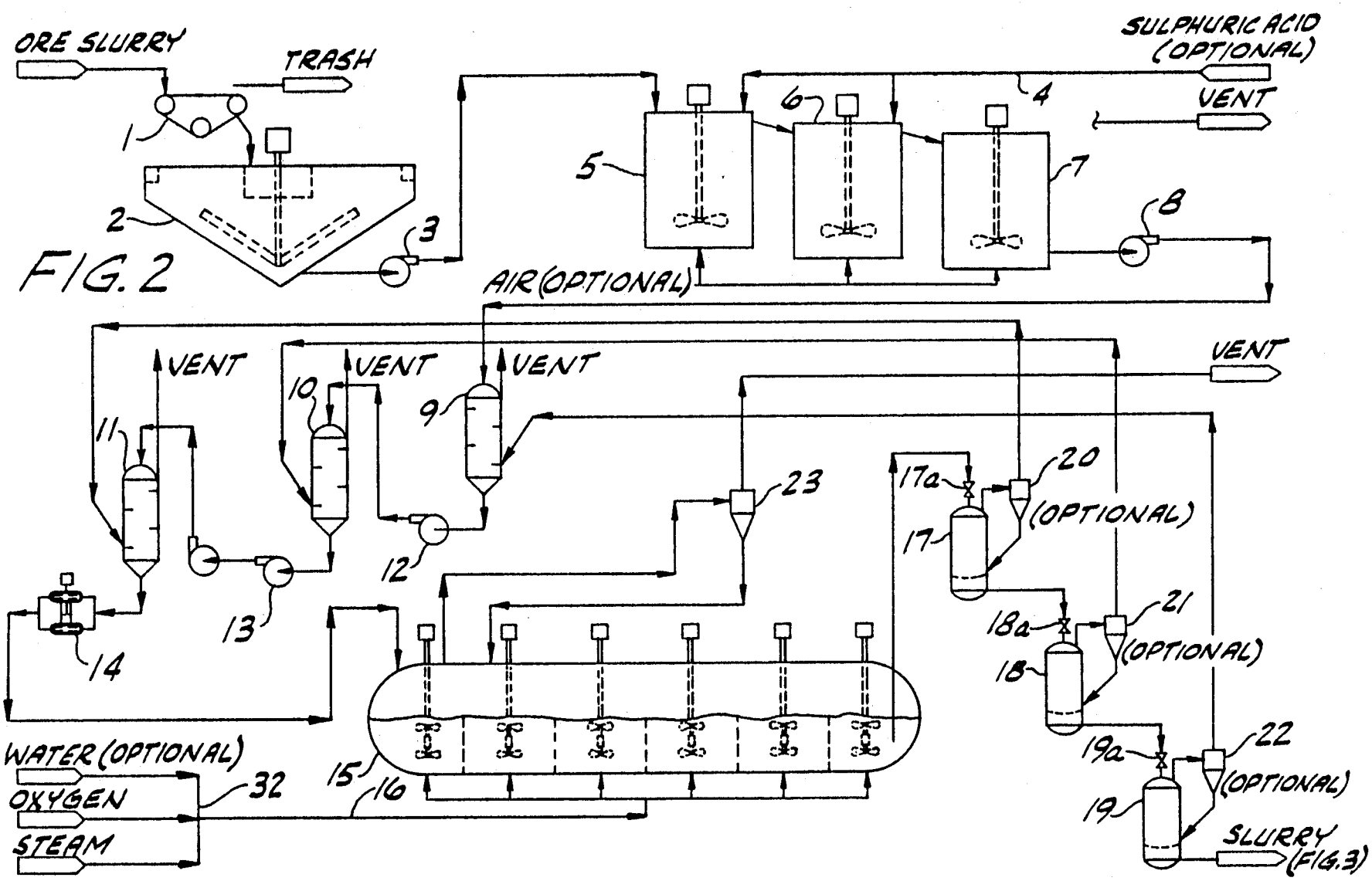
FIG. 2 is a more detailed flowsheet illustrating ore preparation, optional ore acidulation, and pressure oxidation steps in a preferred processing scheme of the invention.

The present invention provides an improved process for recovery of gold from refractory auriferous ores, including relatively lean ores containing as low as 0.10 oz Au per ton. The process is effective for recovery of gold from ores such as those found at the American Barrick Goldstrike property in Nevada, which are sulfidic, and contain iron, arsenic and other heavy metals. In accordance with the process, the various contaminants are oxidized under acidic conditions in a pressure oxidation operation, the sulfuric acid, oxides and salts produced in the pressure oxidation are removed in a neutralization operation, and the neutralized slurry is subjected to carbon-in-leach cyanidation, preferably in a continuous countercurrent manner, for recovery of gold.

In order for the pressure oxidation step of the process of the invention to operate autogenously, the ore used as feed to the process preferably contains at least about 3% by weight sulfur in the form of sulfides. Exothermic oxidation of the sulfide sulfur generates the heat which brings the slurry to the temperature at which not only the sulfur but also the iron and other heavy metals are oxidized. However, by addition of steam to the pressure oxidation step, the process of the invention is also effective for the treatment of refractory sulfide ores containing as low as 1.5% by weight sulfide sulfur. As a further alternative, pyrite concentrates may be blended with the ore feed to provide an additional source of sulfide sulfur and assure that autogenous heat is sufficient to bring the autoclave to the desired reaction temperature and pressure. The latter alternative may provide a further advantage in allowing recovery of gold from the pyrite concentrate, where it is sometimes present in concentrations otherwise too low for economical recovery.

Illustrated in FIG. 1 is a preferred process of the invention. According to the process of this flowsheet, reflecting operation of the process after startup, the ore is crushed and wet milled, and the ground ore slurry screened for trash or tramp material. Next the ground ore is thickened by removal of excess water in a solid-liquid separation operation. The ore slurry is then subjected to pressure oxidation in the presence of sulfuric acid using oxygen gas at elevated pressure. It is sometimes necessary to have sulfuric acid present in order to oxidize sulfide sulfur in the ore, which if not oxidized would not result in the release of the maximum amount of the gold entrapped in the sulfide. In practice, the amount of sulfide sulfur which must be oxidized will depend on the nature of the sulfides present and the distribution of the gold in the various sulfides. Typically, oxidation of 50–95% of the sulfide sulfur will be practiced. Also, the preferential oxidation of the various sulfide sulfur-containing minerals in the ore may be practiced in those cases where the major amount of the gold is not entrapped in all of the various sulfide sulfur-containing minerals in the ore. Since sulfuric acid is generated in the oxidizing step of the instant process once operating conditions are achieved, i.e., after a startup phase, unacidulated ore slurry can be used. However, the sulfuric acid also serves to neutralize the carbonate content of the ore slurry, thereby removing carbonate as carbon dioxide. Accordingly, the ore can be initially acidulated with sulfuric acid prior to passing the slurry to the oxidation step. The amount of acid employed in the separate acidulation step can be up to the stoichiometric amount, that is, an amount which will either partially or substantially completely neutralize the carbonate content of the ore. Thus, the addition of sulfuric acid to the thickened ore slurry is indicated as an optional step.

A preferred process is one which comprises initial acidulation of the ore slurry during startup with fresh sulfuric acid in order to reduce the carbonate content of the ore and shorten the time required to attain the desired sulfuric acid concentration in the oxidation step and then reducing, even eliminating, the addition of fresh acid.

Regardless of the sulfuric acid source for the oxidation step, it is at times important that an excess amount of sulfuric acid be present during oxidation in order to insure that the gold-entrapping sulfide sulfur content of the oxidized slurry is reduced to a practical minimum so as to minimize the amount of gold ending up in the leach tailings. However, the amount of excess acid should be controlled since excess acid will have to be neutralized prior to cyanidation. The amount of excess acid, expressed as the grams of acid per liter of oxidized slurry, should therefore be less than about 25 grams per liter (gpl), preferably less than about 10 gpl and most preferably between about 5–10 gpl.

The pressure oxidation step is typically conducted in a horizontal multi-compartmented autoclave, the compartments of which are preferably of substantially equal volume. Energy from the exothermic pressure oxidation is recovered by heat exchange between the oxidized slurry and acidulated feed to the autoclave. As indicated in FIG. 1, this heat exchange is preferably effected by letting down the pressure of the oxidized slurry, and using the steam which is flashed from the oxidized slurry to heat the autoclave feed, preferably by direct contact in splash condensers positioned ahead of the autoclave.

After it is partially cooled by flashing of steam, the oxidized slurry is further cooled and then passed directly to a neutralization operation. Here lime and/or other base is added to increase the pH to allow for subsequent cyanide leaching. Gold is recovered from the neutralized oxidized slurry by carbon-in-leach cyanidation, preferably in a continuous countercurrent system.

Referring to FIG. 2, ground ore slurry, a substantial fraction of which, for example 65–85% by weight, passes 200 mesh, is directed to a trash screen 1 where rock, wood fiber, trash and plastic larger than 20 mesh are separated and removed. The ore slurry passing through the screen is directed to a mechanical thickening device 2, typically a vertical tank of large diameter which provides a net vertical flow low enough to permit sedimentation of the solid particles. In the thickener, the concentration of the ore slurry is increased from a range of about 10–25% by weight to a range of about 40–55%, preferably 45–50%, by weight. To promote separation of solids, a flocculant is preferably added to the thickener, for example, the polymeric thickener sold under the trade designation Percol 351, at a dosage of about 0.05 to about 0.2 pounds per ton of ore and a concentration in the thickener feed of between about 0.05% and about 2% by weight. Overflow from the thickener is recycled to the grinding circuit. Thickened ore slurry underflow from the thickener is directed by a transfer pump 3 to a series of stirred acidulation tanks 5, 6 and 7, through which the slurry passes continuously. A fresh sulfuric acid stream (optional) 4 is added to the acidulation tanks in order to release carbon dioxide from the carbonate contained in the slurry, and thereby reduce the equivalent carbon dioxide levels in the ore to preferably between about 0.1 and about 0.7% by weight. To promote removal of $CO_2$, compressed air may be sparged into the acidulation tanks.

Residue slurry leaving the acidulation tanks, having an adjusted solids content of at least about 30%, preferably 40–55%, optimum of 45–50% by weight, is fed by a transfer pump 8 to the first of a series of brick lined splash condensers 9, 10 and 11, in which the treated feed slurry for the pressure oxidation step is preheated by contact with steam flashed from the oxidized slurry leaving the pressure oxidation. The successive splash condensers are each, preferably, internally baffled to promote contact between steam and liquid, and are respectively operated at progressively higher pressure and temperature. Centrifugal pumps are interposed to increase the pressure of the slurry between condensers, pump 12 transferring the slurry from condenser 9 to condenser 10, and pumps 13 transferring the slurry from condenser 10 to condenser 11. Preferably, condenser 9 is operated under a slight vacuum, condenser 10 is operated at substantially atmospheric pressure, and condenser 11 is operated under steam pressure.

Pressure oxidation is carried out in an autoclave 15, having a number of segmented, agitated compartments, preferably multilined, the last lining being brick, to which the slurry is transferred, preferably by a diaphragm pump 14, from the last splash condenser 11. Addition of live steam to the slurry leaving the last splash condenser may be indicated for bringing the slurry to a temperature of at least about 175°–180° C., at which the exothermic pressure oxidation reactions become self-sustaining. In the autoclave, the slurry is passed through a plurality of compartments to provide a retention time of the order of 60–80 minutes, where it is contacted in the presence of sulfuric acid with oxygen gas at a temperature of between about 185° and about 225° C., an oxygen partial pressure of at least about 25 psia and a total pressure of between about 215 and about 480 psia. The final acidity of the slurry leaving the last compartment of the autoclave is between 5 and 25 grams sulfuric acid per liter of solution, and the final emf of the slurry is between about 480 and about 530 mv.

Noncondensables and steam generated during the pressure oxidation operation are vented preferably through a cyclone 23 which separates entrained solids for return to the autoclave. In the course of the autoclave operation, iron sulfides are oxidized to ferrous sulfate and sulfuric acid, further oxidation producing ferric sulfate; FeAsS is oxidized to arsenous acid and ferrous sulfate; and arsenous acid is oxidized to arsenic acid:

$$2FeS_2+7O_2+2H_2O\rightarrow 2FeSO_4+2H_2SO_4$$

$$4FeSO_4+2H_2SO_4+O_2\rightarrow 2Fe_2(SO_4)_3+2H_2O$$

$$4FeAsS+11O_2+2H_2O\rightarrow 4HAsO_2+4FeSO_4$$

$$2HAsO_2+O_2+2H_2O\rightarrow 2H_3AsO_4$$

Oxidized slurry leaving the autoclave is passed to a series of flash tanks 17, 18, and 19, through control valves 17*a*, 18*a*, and 19*a*, respectively, where steam is flashed off to cool the slurry. Steam from each flash tank is recycled and contacted with autoclave feed slurry in a complementary splash condenser, operated at substantially the same pressure as the flash tank, for preheating the feed slurry. Thus, in the series as illustrated in the drawing, the first flash tank 17 is coupled to the last splash condenser 11, the second flash tank 18 is coupled with the second condenser 10, and the last flash tank 19 is coupled with the first splash condenser 9.

Steam leaving each of flash tanks 17, 18 and 19 is preferably passed through a cyclone 20, 21 and 22, respectively, for recovery of entrained solids. An alternate is to use large diameter flash tanks. The recovered solids are blended back into the oxidized slurry.

Preferably, the temperature of the pressure oxidation is controlled at a level no higher than about 225° C. Significantly higher temperatures can result in a runaway reaction and resultant overpressurization of the autoclave. Temperature can be controlled by a variety of means, including venting tailgas from the autoclave, venting steam from the first splash tank 17, and/or injecting cold water directly into the autoclave compartments.

Figure 3:
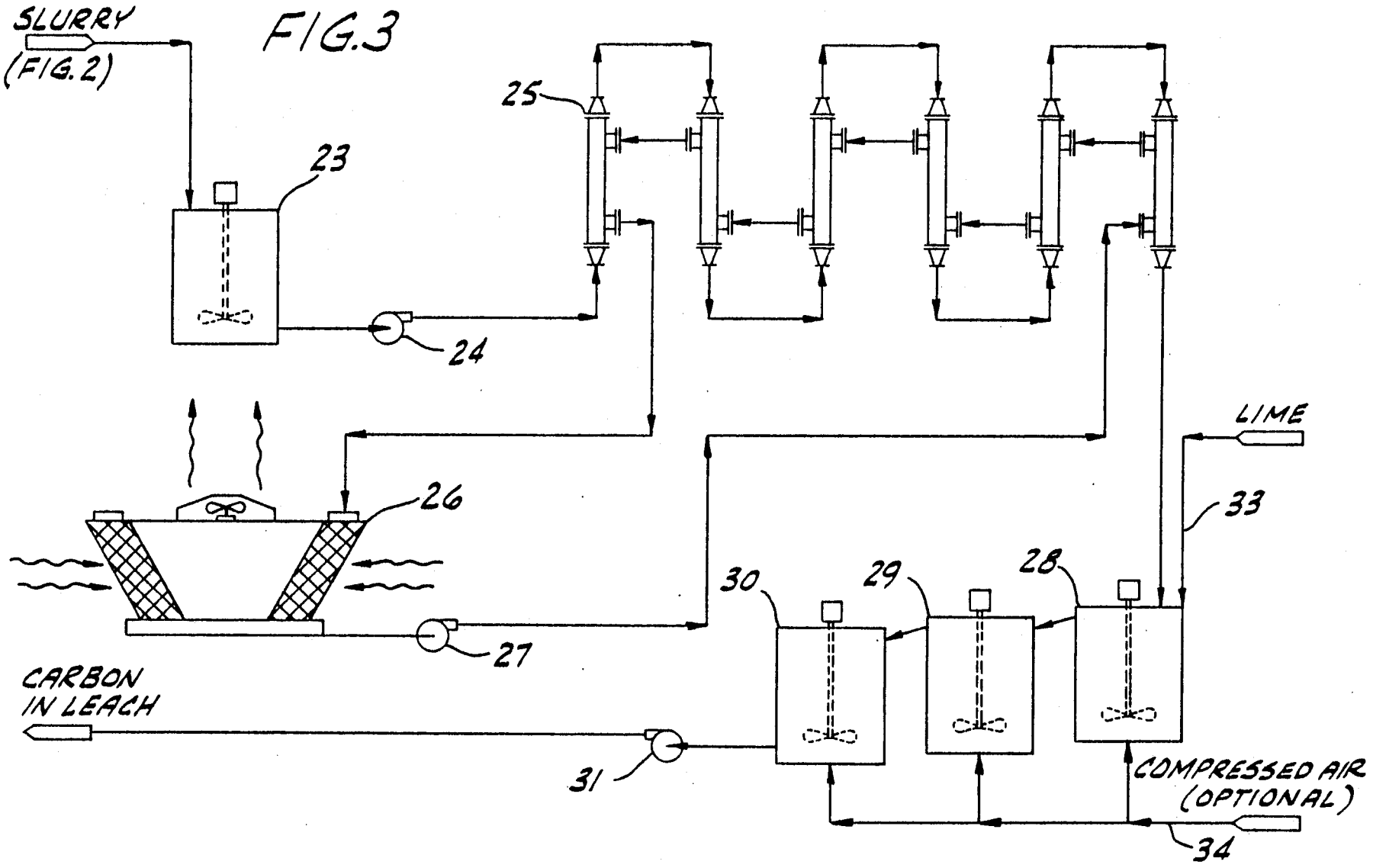
FIG. 3 is a more detailed flowsheet illustrating the oxidized slurry cooling and neutralization steps in a preferred embodiment of the invention.

Referring to FIG. 3, hot oxidized slurry from the autoclave flash tank 19, having a solids content of at least about 30% by weight, preferably at least about 35% by weight, and containing soluble sulfates, iron salts, arsenates, etc., is transferred to an intermediate agitated storage tank 23. In order to condition the slurry for gold recovery operations, the temperature of the hot oxidized slurry is reduced to about 25° to 40° C. by passing the slurry, by means of pump 24, through a series of shell and tube coolers 25. The temperature of the slurry is reduced by exchanging heat from the slurry to a cooling water stream. Cooling water is obtained from a recirculating system in which the water is recycled through a crossflow, induced draft cooling tower 26 by pump 27.

Cooled oxidized slurry which is discharged from the coolers 25 is fed continuously through a series of rubber or epoxy lined agitated neutralization tanks 28, 29 and 30, where it is neutralized with a slurry of lime and/or other base to raise its pH to the neighborhood of 10 to 12, preferably about 10.5. Lime is highly preferred but the neutralization may be carried out with other bases which form substantially insoluble sulfate salts on reaction with sulfuric acid and are capable of raising the pH to a level at which iron and arsenate salts are precipitated. Compressed air 34 is optionally sparged into the slurry in the neutralization tanks to convert ferrous iron to ferric iron, as the former consumes cyanide in the subsequent carbon-in-leach operation. The neutralized slurry, having a solids content of 30–40% by weight and at a temperature of about 25°–35° C., is then directed to a carbon-in-leach operation by transfer pump 31.

The gold in the oxidized slurry is recovered by a conventional carbon-in-leach (C-I-L) cyanidation or cyanidation followed by carbon-in-pulp (C-I-P) (not shown in detail) in which the neutralized slurry is passed to a series of agitated carbon-in-leach tanks countercurrently to a flow of granular activated carbon. Loaded carbon recovered from the carbon-in-leach operation is stripped with hot alkaline cyanide solution and gold is recovered from the stripping solution by conventional means such as electrowinning and refining (not shown).

The process of the invention provides for high recovery of gold, for example, in a yield exceeding 80%, from refractory auriferous ores containing 0.10 to 0.50 oz gold per ton. It is effective for removing contaminating elements such as iron, arsenic, nickel, and zinc from the oxidized slurry, and can be implemented with relatively modest capital investment. The autoclave conditions and means for recovery of exothermic reaction heat provide not only efficient gold recovery but efficient use of energy. As a result of reducing the amount of sulfuric acid in the oxidized slurry not only is there a reduction in the amount of lime used and the quantity of salts generated but the equipment ancillary to the autoclave can be manufactured from less costly materials of construction. For example items of equipment, piping, valves and the like can be constructed of alloy 20 or stainless steel instead of titanium or alloy 20 as has been the prior practice. Also, the instant process, through elimination of the washing operation between the autoclave and the neutralization operation, reduces the volume of materials handled and avoids the need for other ancillary operations such as wash water recovery.

In another embodiment (not shown) the transfer of heat from the oxidized slurry to the treated slurry autoclave feed can be accomplished by indirect heat exchange rather than by coupled flash tanks and splash condensers. In that embodiment the indirect heat exchanger is preferably a double pipe exchanger in which the inner pipe is constructed of an acid resistant metal or alloy and the outer pipe of steel. The oxidized slurry is passed through the interior pipe and the relatively cold pressure oxidation feed slurry is passed through the annular space between the pipes. The interior pipe of the heat exchanger, which is in contact with the highly acidic streams leaving the autoclave need not be constructed from titanium as generally has been the practice. Instead, alloy 20 or other similar acid resistant alloy can be used, thereby significantly lowering the cost of the heat exchanger.

Further illustrations of the process of this invention are given below.

A supply of ore referred to as Betze ore was pulverized to minus 200 mesh and samples of the ore were fire assayed for gold and silver, and other elements of interest. The averaged analyses are listed in Table 1 and show average gold analyses of 0.206 oz Au/ton.

TABLE 1

| Betze Ore Composite Analyses | |
|---|---|
| Gold, oz/ton | 0.206 |
| Silver, oz/ton | 0.03 |
| Copper, % | 0.007 |
| Lead, % | 0.009 |
| Zinc, % | 0.035 |
| Iron, % | 2.93 |
| Sulfur, % total | 2.75 |
| Sulfur, % sulfide | 2.40 |
| Carbon, % total | 1.36 |
| Carbon, % $CO_3$ | 3.06 |
| Carbon, % organic | 0.75 |
| Mercury, ppm | 26.1 |
| Arsenic, ppm | 1465 |

EXAMPLE 1

A pilot plant, arranged in a manner generally corresponding to the flow sheet of FIG. 1, initially was operated continuously for about 35 hours (not including time for repairs) using the Betze ore. The autoclave conditions during this period are listed in Table 2. Sulfuric acid in a proportion of 100 lbs. per ton of ore feed was added to the autoclave feed which was the stoichiometric amount required to neutralize the natural carbonate in the ore.

TABLE 2

| Start-Up Conditions for Pilot Plant Autoclave | |
|---|---|
| Autoclave Feed | |
| Feed | 40% solids by weight<br>~85% passing 200 mesh<br>10.8 kg/hr. |
| Autoclave Conditions | |
| Temperature | 435° F. (225° C.) |
| Pressure | 420 psig total |
| Oxygen | 152 lb $O_2$/ton ore feed<br>50 psig $O_2$ overpressure |
| Bleed gas | 2.0 l/min |
| Acid addition | 100 lb $H_2SO_4$/ton ore |
| Mixing speed | 500 rpm |
| Retention time | 75 minutes |

After the initial 35 hours of operation the acid addition to the autoclave was reduced to 50 lb/ton of ore feed and the operation continued at that level of acid addition for approximately 18 hours, not including downtime.

Acid addition to the autoclave feed was then terminated. The neutralization and CIL operations were drained to achieve equilibrium as quickly as possible and the plant was operated with no acid addition for about 20 hours. Samples of in-process materials downstream of the autoclave were taken and the pilot plant was then shut down. Representative data from operating at each of the three different acid levels are summarized in Table 3.

TABLE 3

Summary of Average Measured Data

| | Acid Addition to Autoclave Feed, lb $H_2SO_4$/ton Ore | | |
|---|---|---|---|
| | 100 | 50 | 0 |
| Autoclave Discharge Slurry | | | |
| Free acid, g $H_2SO_4$/liter | 20.8 | 9.8 | 5.2 |
| emf, mv | 432 | 432 | 410 |
| pH | 0.9 | 1.1 | 0.9 |
| % solids | 47 | 42 | 44 |
| Neutralization | | | |
| Stage 1 lime addition, lb CaO/ton ore[1] | 71.2 | — | 11.4 |
| Stage 1 temp, °C. | 53 | 52 | 54 |
| Stage 4 temp, °C. | 32 | 28 | 28 |
| CIL | | | |
| Stage 1 cyanide addition, lb NaCN/ton ore | 1.5 | 1.5 | 1.5 |
| Stage 8 residual NaCN, g NaCN/liter | 0.11 | NA | 0.25 |
| NaCN consumption, lb NaCN/ton ore | 0.9 | 0.8 | 0.6 |
| Tailings solids, oz Au/ton | 0.016 | NA | 0.016 |
| % gold dissolution[2] | 91.8 | NA | 91.8 |
| Batch CIL Tests (Laboratory) | | | |
| Tailings solids, oz Au/ton | 0.016 | 0.020 | 0.020 |
| % Gold dissolution | 92.1 | 90.5 | 90.3 |
| NaCN consumption, lb NaCN/ton ore | 1.10 | 1.00 | 1.08 |

[1]Based on a lime feed with 90% availability.
[2]Based on no weight changes and an average assayed CIL feed of 0.196 oz
NA = Not Available The higher free acid in the first period of operation required the use of 71.2 lb of CaO per ton of ore feed for neutralization. This compares to only 11.4 lb required when no acid was added to the autoclave. No reliable result was determined for the period when 50 lb of acid was added. The autoclave achieved excellent sulfide sulfur oxidation for all three rates of acid addition. In all cases sulfide sulfur oxidation was greater than 95%.

The cyanide leach circuit was started using a cyanide addition rate of 1 lb of NaCN per ton of ore feed (with material produced in the autoclave using 100 lb of acid addition). However, after approximately four hours of leaching the cyanide addition was increased to 1.5 lb of NaCN per ton of ore feed. It remained at this level throughout the remaining pilot plant operation.

Leaching the material produced in the autoclave with 100 lb/ton of acid addition consumed 0.9 lb NaCN/ton of ore feed. The consumption decreased to 0.6 lb NaCN/ton of ore when the autoclave was operated with 0 lb/ton of acid addition. The value of 0.8 lb NaCN/ton of ore feed for the consumption with 50 lb of acid/ton addition to the autoclave is an estimate.

Leaching the material produced in the autoclave with 100 lb of acid addition per ton achieved CIL tailings assaying 0.014 to 0.018 oz Au/ton and averaging 0.016 oz Au/ton. This corresponded to a gold dissolution of 91.8% based on an assayed leach feed of 0.196 oz Au/ton. The CIL tailings for material produced with 0 lb of acid addition per ton also assayed 0.016 oz Au/ton and show a gold dissolution of 91.8%. No reliable pilot plant CIL tailings were produced using 50 lb of acid addition per ton of ore.

A summary of the analyses of the CIL tailings with either 100 or 0 lb of acid addition is given in Table 4.

TABLE 4

Analyses of Samples from Each Leach Stage for 100 and 0 lb of Acid Added per Ton of Autoclave Feed

| | 100 lb. Acid Addition to Autoclave Feed | | | No Acid Addition to Autoclave Feed | | | Carbon[1] | | |
|---|---|---|---|---|---|---|---|---|---|
| CIL Stage | Solids oz Au/ton | Liquor mg Au/l | NaCN g/l | Solids oz Au/ton | Liquor mg Au/l | NaCN g/l | oz Au/ton | ppm As | ppm Hg |
| 1 | 0.016 | 0.54 | 0.43 | 0.022 | 0.318 | 0.60 | 144.8 | 0.8 | 0.2 |
| 2 | 0.014 | 0.062 | | 0.020 | 0.038 | 0.46 | 21.9 | 2.0 | 70.3 |
| 3 | 0.018 | 0.009 | | 0.018 | 0.007 | 0.40 | 3.81 | 9.1 | 117 |
| 4 | 0.016 | 0.006 | 0.22 | 0.018 | <0.004 | 0.37 | 1.02 | 26.9 | 154 |
| 5 | 0.020 | <0.004 | | 0.018 | <0.004 | 0.32 | 0.419 | 43.9 | 108 |
| 6 | 0.020 | <0.004 | | 0.016 | <0.004 | 0.25 | 0.402 | 60.7 | 112 |
| 7 | 0.022 | <0.004 | | | | | 0.151 | | |
| 8 | 0.024 | <0.004 | 0.10 | | | | 0.173 | | |

[1]The same carbon was used in the CIL stages throughout the entire pilot plant operation.

The tailings from the batch laboratory CIL tests (Table 3) generally confirm the results achieved in the pilot plant. For example, the tailings from the material produced with 100 lb of acid addition averaged the same as the plant tailings: 0.016 oz Au/ton. The metallurgical balances for the batch tests show a corresponding gold recovery of 92.1% onto the loaded carbons.

The plant tailings for the period with 0 lb of acid addition assayed 0.016 oz Au/ton which was lower than the value of 0.020 oz Au/ton achieved by the batch CIL tests. This is contrary to expectations. However, the differences are small and due to the small number of data points, they are considered to be within a range of normal experimental and analytical precision. There were no plant tailings for comparison with 50 lb of acid but the batch CIL tailings averaged 0.020 oz Au/ton with a corresponding gold recovery of 90.3% onto the loaded carbon.

Based on these data it is evident that the autoclave oxidation process performed very well with all three acid addition rates. It is also evident that each of the acid addition rates produced autoclave solids which were amenable to cyanidation and that CIL tailings assaying 0.02 oz Au/ton or less can be achieved.

Also, it was observed that the autoclave will function well with no acid addition if the oxidation reaction is in progress (after startup). However, it is apparent that some free acid must be present in the autoclave to initiate the oxidation reaction. In the preferred embodiment therefore, provision is made for adding acid to the autoclave feed to start the reaction. Thereafter, the autoclave can be operated without acid addition if desired.

Additional analytical data for the various plant samples are given in Table 5.

TABLE 5

| Average Analyses for Various Pilot Plant Samples for the Three Acid Additions | lb of Acid Added to Autoclave Feed | | | |
|---|---|---|---|---|
| | 100 | 50 | 0 | Overall |
| Autoclave Ore Feed before Acid | | | | |
| Gold, oz/ton | 0.212 | 0.206 | 0.214 | 0.206[1] |
| Sulfur, % sulfide | 1.89 | | 1.84 | 1.87 |
| Arsenic, ppm | 1865 | | 1870 | 1867 |
| Autoclave Ore Feed with Acid | | | | |
| Gold, oz/ton | 0.207 | — | — | |
| Sulfur, % sulfide | | | | |
| Autoclave Discharge Solids | | | | |
| Gold, oz/ton | 0.207 | 0.204 | 0.206 | 0.206 |
| Sulfur, % sulfide (% $S^{=}$ oxidation) | 0.06 (97.1) | 0.09 (95.7) | 0.10 (95.2) | |
| Carbonate, % $CO_3$ | 0.05 | 0.03 | 0.02 | |
| Arsenic, ppm | 1644 | 1685 | 1403 | |
| Autoclave Discharge Liquor | | | | |
| Iron, total mg/l | 1288 | 524 | 309 | |
| Iron, ferrous mg/l | 437 | 233 | 150 | |
| Iron, ferric mg/l | 851 | 291 | 159 | |
| Iron, ferrous/ferric | 0.51 | 0.80 | 0.94 | |

[1]Weighted average of all head assays.

The gold analyses of the CIL tailings and the sulfide sulfur analyses of the autoclave solids are discussed above.

In Table 6 the average pH values and temperatures for each of the four neutralization stages are summarized. The same data for the eight CIL stages are summarized in Table 7 along with the average cyanide concentrations. These data do not show any unexpected or unusual trends. The temperatures in the neutralization circuit decreased from about 53° C. in the first stage to 32° C. or less in the last stage. The pH values in the last two neutralization stages during the period using 50 lb of acid were 11.2 to 11.7 which was higher than desired. Otherwise the pH values were very close to the preferred value of 10.5.

TABLE 6

| Average Values for Neutralization Circuit | | | | | | | | |
|---|---|---|---|---|---|---|---|---|
| Acid Added to Autoclave Feed | Stage | | | | | | | |
| | 1 | | 2 | | 3 | | 4 | |
| lb $H_2SO_4$/ton Ore | pH | °C. | pH | °C. | pH | °C. | pH | °C. |
| 100 | 10.7 | 53 | 10.7 | 45 | 10.8 | 37 | 10.9 | 32 |
| 50 | 10.2 | 52 | 10.5 | 42 | 11.2 | 34 | 11.7 | 28 |
| 0 | 10.5 | 54 | 10.4 | 45 | 10.4 | 35 | 10.4 | 28 |

The temperatures for all eight CIL stages were less than 30° C. and at the end of leaching the temperature in the last stage was equal to the ambient room temperature of approximately 24° C.

TABLE 7

| Average Values for CIL Circuit | | | |
|---|---|---|---|
| | | Acid Added to Autoclave Feed lb $H_2SO_4$/ton Ore | |
| CIL Stage | | 100 | 0 |
| 1 | pH | 10.8 | |
| | °C. | 28 | N/A |
| | g NaCN/l | 0.39 | 0.60 |
| 2 | pH | 10.7 | |
| | °C. | 28 | N/A |
| | g NaCN/l | 0.30 | 0.46 |
| 3 | pH | 10.8 | |
| | °C. | 26 | N/A |
| | g NaCN/l | 0.25 | 0.40 |
| 4 | pH | 10.8 | |
| | °C. | 25 | N/A |
| | g NaCN/l | 0.21 | 0.37 |

TABLE 7-continued

| Average Values for CIL Circuit | | | |
|---|---|---|---|
| | | Acid Added to Autoclave Feed lb $H_2SO_4$/ton Ore | |
| CIL Stage | | 100 | 0 |
| 5 | pH | 10.8 | |
| | °C. | 25 | N/A |
| | g NaCN/l | 0.18 | 0.32 |
| 6 | pH | 10.8 | |
| | °C. | 24 | N/A |
| | g NaCN/l | 0.15 | 0.25 |
| 7 | pH | 10.8 | |
| | °C. | 24 | — |
| | g NaCN/l | 0.15 | |
| 8 | pH | 10.8 | |
| | °C. | 24 | — |
| | g NaCN/l | 0.11 | |

The data in Table 7 show that there were measurable differences in the residual cyanide concentrations for the two periods using either 100 or 0 lb of acid addition. In both cases, 1.5 lb of NaCN was added to the CIL circuit, but the residual cyanide in the last CIL stage was 0.11 g NaCN/liter for the material produced with 100 lb of acid addition. This compares to a residual cyanide of 0.25 g NaCN/liter for the material produced with no acid addition. These data, as well as the consumption values discussed earlier, show that the material produced by the autoclave with no acid addition has a lower potential for consumption of cyanide.

During all three periods of operation, a positive bleed of the autoclave gas was used to maintain a constant total pressure of 420 psig. This "bleed" or "off-gas" was passed through a water cooled condenser to remove moisture and then through either a standard rotameter for volumetric measurements, or through a gas train for analysis. The gas train consisted of a desiccant for removal of trace water vapor and two on-stream instruments for measuring percentages of oxygen and carbon dioxide.

The average gas analysis values for the three periods of operation are listed in Table 8. The oxygen percentages ranged from 91.3% when the higher acid addition was used to 86.6% when no acid was added. This is the expected trend since the higher acid addition rate neutralized the majority of the carbonates and the carbon dioxide was vented to the atmosphere prior to autoclaving. Likewise, when no acid was added all of the carbon dioxide associated with the carbonates was released inside of the autoclave and this resulted in the higher carbon dioxide content of the bleed gas.

TABLE 8

| | Autoclave Bleed Gas Analyses | | |
|---|---|---|---|
| | lb of Acid Added/Ton of Feed | | |
| Gas Ingredient | 100 | 50 | 0 |
| $O_2$, % | 91.3 | 90.2 | 80.6 |
| $CO_2$, % | 4.2 | 5.2 | 10.2 |
| Hg, ppm | $4.9 \times 10^{-4}$ | $2.7 \times 10^{-4}$ | $0.9 \times 10^{-4}$ |
| $SO_2$, ppm | — | — | 0.002 |
| $H_2S$, ppm | — | — | 10 |

All analyses are on a dry gas basis.

Samples of the bleed gas from each period of operation were analyzed for mercury using a gold film mercury detector manufactured by Jerome Instruments. This is a sensitive instrument which can measure nanogram amounts of mercury. The values listed in Table 8 range from 0.9 to $4.9 \times 10^{-4}$ ppm mercury in the bleed gas. The mercury concentrations decreased in accordance with decreased acid additions to the autoclave feed.

Colorimetric gas indicating tubes were used to provide semi-quantitative gas analyses for sulfur dioxide and hydrogen sulfide during the last period of operation with no acid addition. These tubes are relatively selective and, over a measured length of each tube, a color change will indicate the presence of the selected gas and also its concentration. The tubes are designed to be used for sampling 100 $cm^3$ of ambient air. However, in the present application a total of 10 liters of bleed gas was passed through each tube to increase the detection limit.

In neither case was there any color change. This indicates that the gases in question were either not present or were present in concentrations lower than the values listed in Table 8.

The leach slurries in each of the CIL stages were sampled during the two periods of operation using 100 or 0 lb of acid addition. Each slurry was filtered, and the solids were assayed for gold and the liquors for gold and cyanide. These are designated as "profile" samples and are used to show the gold leaching kinetics. The results are summarized in Table 4.

The leach tailings assays for the period with 100 lb of acid addition increased with each successive leach stage. In Stage 1, the tailings assayed 0.016 oz Au/ton but increased to 0.024 oz Au/ton in Stage 8. This is contrary to the expected trend of either near constant tailings throughout the leach circuit or very small decreases with each successive stage. In either case the data indicated very rapid gold dissolution rates.

The data, however, are not believed to be indicative of either a decreased leaching response and/or other problems such as carbonaceous material in the ore robbing gold cyanide complexes and thereby reducing gold recovery (preg robbing). Instead, the observed trend is probably a result of the lower cyanide addition rate (1 lb NaCN/ton of ore) which was used to start the leach circuit. The higher tailings in the latter four leach stages represent material which was leached with the lower cyanide addition and which was still in the circuit when it was sampled.

The tailings in the first four stages are believed to be indicative of the leaching response using the higher cyanide concentration. They ranged in assay from 0.014 to 0.018 oz Au/ton and averaged 0.016 oz Au/ton. These data show that the material produced by the autoclave during this period was amenable to cyanidation. This conclusion is supported by the results of the batch CIL tests (see Table 3) and showed tailings with an identical average of 0.016 oz Au/ton.

In summary, it is concluded that the results from the first four plant leach stages are indicative of the performance of a leach circuit operating under steady-state conditions with the higher cyanide addition rate of 1.5 lb NaCN/ton. The average value of 0.016 oz Au/ton for the tailings from the first four leach stages was used in Table 3 to calculate the gold dissolutions of 91.8%.

The data for the period of operation with no acid addition show decreasing tailings assays with each successive leaching stage and show a less rapid but still a quick rate of gold dissolution. The value of 0.016 oz Au/ton for the tailings from the last leach stage was used in Table 3 to calculate the gold dissolution values of 91.8% based on a CIL leach feed assay of 0.196 oz Au/ton.

Each autoclave compartment was sampled during the periods when 100 and 0 lb of acid were added. One split of solids from each sample was assayed for gold and sulfide sulfur, and a second split was leached in the laboratory. The results are summarized in Table 9.

In both cases the oxidation of the sulfide sulfur in the first compartment was incomplete and this resulted in decreased gold dissolutions. When 100 lb of acid was added, the first compartment solids assayed 0.21% $S^=$ and a batch CIL leach of this material achieved tailings assaying 0.030 oz Au/ton. This corresponded to a gold dissolution of 85.3%. By comparison, the solids in the second compartment assayed 0.10% $S^{32}$ and the leach tailings assayed 0.016 oz Au/ton with a calculated gold dissolution of 91.9%. The third and fourth compartment samples contained even lower concentrations of sulfide sulfur and demonstrated higher gold dissolutions.

The same trend was produced by the samples from the period with 0 lb acid addition, except the sulfide sulfur values did not decrease as much nor as quickly.

TABLE 9

| Laboratory Batch CIL cyanidation Test Results for Autoclave Acid Additons of 100 and 0 lb $H_2SO_4$/ton Ore | | |
|---|---|---|
| | Acid Added to Autoclave Feed lb $H_2SO_4$/ton Ore | |
| Autoclave Compartment | 100 | 0 |
| 1. Leach tailings, oz Au/ton | 0.030 | 0.052 |
| % Gold dissolution | 85.3 | 76.3 |
| Leach feed solids, % $S^=$ | 0.21 | 0.76 |
| Carbonate, % $CO_3^=$ | 0.04 | 0.63 |
| NaCN added, lb NaCN/ton ore | 2.17 | 2.86 |
| NaCN consumed, lb NaCN/ton ore | 1.88 | 2.35 |
| Free acid, g $H_2SO_4$/liter | 18.4 | <0.1 |
| 2. Leach tailings, oz Au/ton | 0.016 | 0.018 |
| % Gold dissolution | 91.9 | 91.7 |
| Leach feed solids, % $S^=$ | 0.10 | 0.16 |

TABLE 9-continued

Laboratory Batch CIL cyanidation Test Results for Autoclave Acid Additons of 100 and 0 lb $H_2SO_4$/ton Ore

| Autoclave Compartment | Acid Added to Autoclave Feed lb $H_2SO_4$/ton Ore 100 | 0 |
|---|---|---|
| Carbonate, % $CO_3^=$ | 0.02 | 0.07 |
| NaCN added, lb NaCN/ton ore | 2.04 | 2.88 |
| NaCN consumed, lb NaCN/ton ore | 1.22 | 2.25 |
| Free acid, g $H_2SO_4$/liter | 22.6 | 0.1 |
| 3. Leach tailings, oz Au/ton | 0.010 | 0.020 |
| % Gold dissolution | 94.8 | 90.6 |
| Leach feed solids, % $S^=$ | 0.06 | 0.09 |
| Carbonate, % $CO_3^=$ | 0.02 | 0.07 |
| NaCN added, lb NaCN/ton ore | 2.18 | 2.42 |
| NaCN consumed, lb NaCN/ton ore | 1.62 | 1.17 |
| Free acid, g $H_2SO_4$/liter | 21.6 | 2.7 |
| 4. Leach tailings, oz Au/ton | 0.010 | 0.020 |
| % Gold dissolution | 94.7 | 90.5 |
| Leach feed solids, % $S^=$ | 0.05 | 0.09 |
| Carbonate, % $CO_3^=$ | 0.02 | 0.06 |
| NaCN added, lb NaCN/ton ore | 1.93 | 2.57 |
| Free acid, g $H_2SO_4$/liter | 22.4 | 2.7 |

EXAMPLE 2

Ten laboratory batch autoclave tests were made using the pilot plant ore feed (ground Betze ore). Tests A to E used an addition of 104 lb of sulfuric acid per ton of ore feed, a termperature of 435° F., a total pressure of 420 psig, and a feed of 40% solids. The tests differed only in their retention times which ranged from 0 to 90 minutes. The procedure for Tests F to J was identical except that no acid was added to the autoclave feed.

In Tests A–E acid was added to the ground ore slurry and thoroughly mixed. In all the tests the autoclave was sealed and heated to the desired temperature. Oxygen was then introduced through a sparge tube into the mixed ore slurry and the time for the test was started. The heating process generally required 12 to 15 minutes. The test with zero time was simply heated and the test was then terminated.

A positive flow of oxygen was provided by bleeding the autoclave gas at the rate of 800 to 1000 $cm^3$/minute. At the end of each test, the autoclave was quickly cooled with water and a sample of the autoclave slurry was filtered. The solids were assayed for gold and sulfide sulfur and the liquor for free acid.

The remaining portion of the solids was neutralized with milk of lime and leached for 16 hours using fresh carbon (GRC 20) and the addition of approximately 2.25 lb of NaCN per ton of leach feed.

The results, summarized in Table 10, show gold dissolutions ranging from approximately 25 to 94% for the autoclave products which contained residual sulfide sulfur concentrations of less than 0.07 to 2.00% $S^=$.

Figure 4:
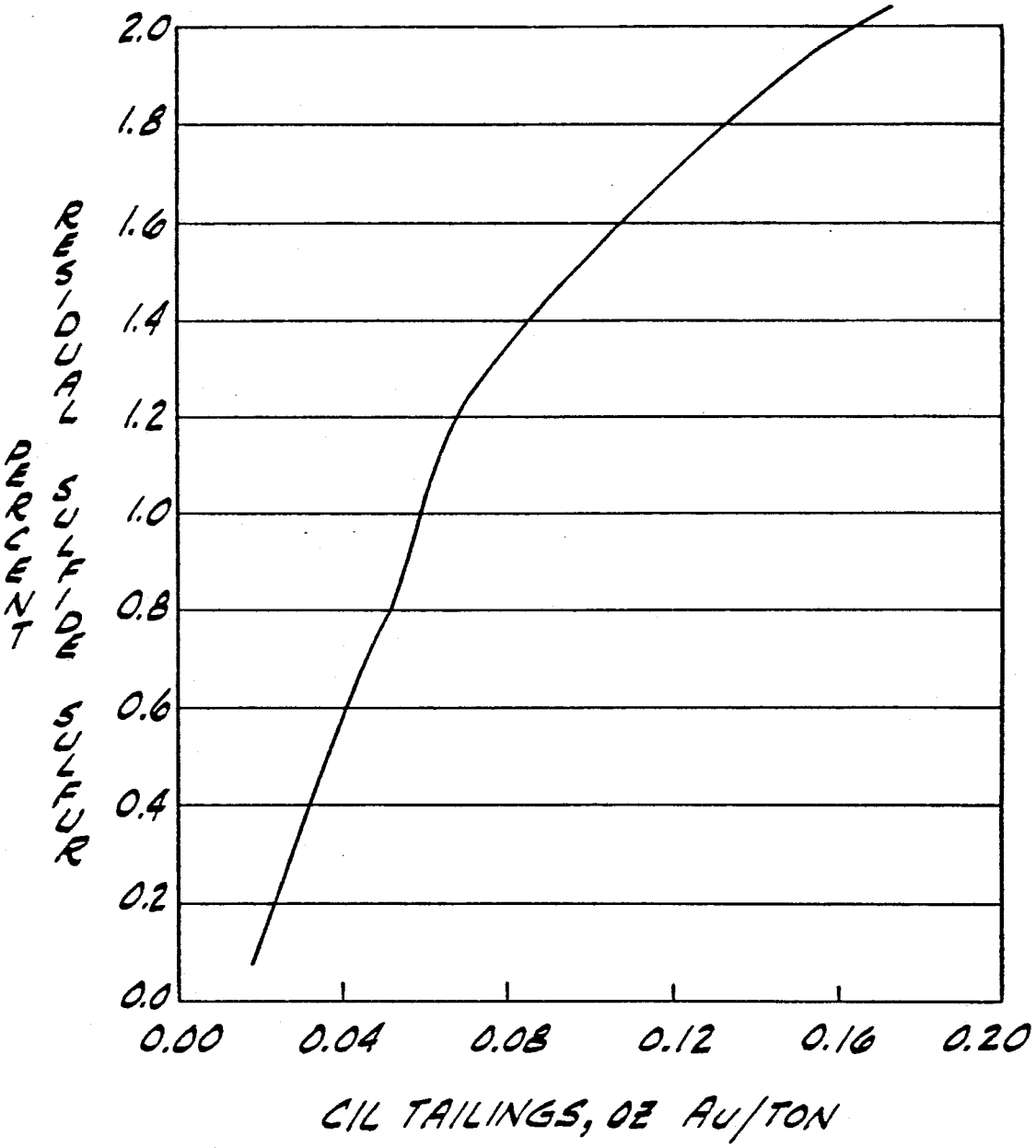
FIG. 4 is a curve indicating, for Betze ore, the relationship between the percent sulfide sulfur in the oxidized slurry and the amount of unrecoverd gold, that is, gold from the feed ore, present in the leach operation tailings.

The relationship between the residual sulfide sulfur and the corresponding cyanide leach tailings for the Betze ore is shown graphically in FIG. 4. These data clearly show that gold dissolution increased in response to decreasing residual sulfide sulfur. The data indicate that for the Betze ore a leach tailings of less than 0.02 oz Au/ton can be achieved when the autoclave solids assay approximately <0.1% $S^=$.

TABLE 10

Batch CIL Cyanidation of Laboratory Autoclave Tests using Betze Ore and Various Autoclave Times and Acid Additions

| | Autoclave | | Weights and Volumes | | | | | Analyses | | | |
|---|---|---|---|---|---|---|---|---|---|---|---|
| | | | | | | | | Barren Liquor | | Tails Solids | Loaded Carbon |
| | Added Acid | | Barren Liquor | Tails Solids | Loaded Carbon | Slurry | | | | | |
| Test | lb/T | Time, min | ml | g | g | g | % Solids | Au mg/l | NaCN g/l | Au oz/T | Au oz/T |
| A | 104 | 0 | 2115 | 527.78 | 14.93 | 1493 | 35.7 | 0.007 | 0.14 | 0.158 | 1.84 |
| B | 104 | 23 | 1620 | 537.24 | 14.68 | 1567 | 34.6 | 0.004 | 0.15 | 0.018 | 7.35 |
| C | 104 | 45 | 1640 | 537.26 | 15.12 | 1545 | 35.1 | 0.004 | 0.15 | 0.018 | 7.28 |
| D | 104 | 68 | 1640 | 523.59 | 14.69 | 1573 | 33.6 | 0.004 | 0.04 | 0.016 | 7.35 |
| E | 104 | 90 | 2292 | 533.18 | 14.60 | 1597 | 33.7 | 0.004 | 0.10 | 0.014 | 7.56 |
| F | 0 | 0 | 1585 | 545.46 | 14.13 | 1512 | 36.4 | 0.004 | 0.10 | 0.164 | 2.04 |
| G | 0 | 23 | 1590 | 546.31 | 15.06 | 1514 | 36.4 | 0.004 | 0.10 | 0.076 | 5.21 |
| H | 0 | 45 | 1510 | 539.99 | 15.01 | 1532 | 35.6 | 0.004 | 0.12 | 0.062 | 5.75 |
| I | 0 | 68 | 1457 | 535.65 | 15.11 | 1501 | 36.0 | 0.004 | 0.12 | 0.052 | 6.04 |
| J | 0 | 90 | 1550 | 540.20 | 14.11 | 1494 | 36.5 | 0.004 | 0.15 | 0.048 | 6.70 |

| | Calculated Values | | | | | Measured Values | | | |
|---|---|---|---|---|---|---|---|---|---|
| | Cyanide[1] | | | Feed, | % Gold | Leach | | Leach Feed | |
| Test | g/l (a) | lb/T (b) | lb/T (c) | Au oz/T | Dissolution | Dissolved Oxygen, ppm | Leach pH | Sulfide Sulfur, % | Au oz/T |
| A | 0.31 | 1.15 | 2.27 | 0.211 | 25.1 | | | 2.00 | 0.210 |
| B | 0.24 | 1.33 | 2.23 | 0.219 | 91.8 | 7.2 | 10.4 | 0.07 | 0.212 |
| C | 0.25 | 1.32 | 2.23 | 0.223 | 91.9 | 7.2 | 10.3 | 0.07 | 0.212 |
| D | 0.06 | 2.04 | 2.29 | 0.222 | 92.8 | 6.9 | 10.0 | 0.07 | 0.210 |
| E | 0.22 | 1.39 | 2.25 | 0.221 | 93.7 | | | 0.08 | 0.208 |
| F | 0.17 | 1.62 | 2.20 | 0.217 | 24.5 | 5.7 | 10.7 | 2.00 | 0.218 |
| G | 0.17 | 1.61 | 2.20 | 0.220 | 65.5 | 6.7 | 10.6 | 1.37 | 0.216 |
| H | 0.19 | 1.55 | 2.22 | 0.222 | 72.1 | 6.8 | 10.5 | 1.10 | 0.212 |
| I | 0.18 | 1.59 | 2.24 | 0.223 | 76.6 | 6.9 | 10.4 | 0.77 | 0.190 |

TABLE 10-continued

Batch CIL Cyanidation of Laboratory Autoclave Tests using Betze Ore and Various Autoclave Times and Acid Additions

| | | | | | | | | | |
|---|---|---|---|---|---|---|---|---|---|
| J | 0.25 | 1.36 | 2.22 | 0.223 | 78.5 | 6.9 | 10.3 | 0.77 | 0.214 |

[1]The cyanide values are reported as: (a) residual concentration at the end of the leach as g NaCN/liter, (b) as pounds of NaCN consumed per ton of leach feed and, (c) as pounds of NaCN added per ton of leach feed.
The autoclave conditions were:
435° F.
420 psig total pressure
40% solids
Betze ore at 85% passing 200 mesh.

In all cases, however, the batch laboratory autoclave tests with no acid produced results which were inferior to those achieved in the pilot plant with no acid addition. For example, with no acid addition and only 75 minutes retention the pilot plant autoclave produced solids assaying 0.11% S=. The batch CIL cyanidation of these CIL solids achieved tailings assaying 0.016 oz Au/ton. By comparison, the 90-minute batch autoclave test with no acid addition produced solids assaying 0.77% S= and corresponding batch CIL tailings of 0.048 oz Au/ton.

The reason for these differences was the lack of free acid at the start of the batch autoclave tests. The presence of free acid appears to be an important factor for the oxidation process. In the pilot plant the switch was made between 50 and 0 lb of acid addition and free acid was present in the autoclave. The amount of free acid was sufficient to maintain the oxidation reaction, and the oxidation of the sulfides provided enough acid to further maintain the reaction. In the batch tests the lack of free acid slowed the oxidation reaction and even after 90 minutes the reaction was incomplete.

The pilot plant autoclave data showing retention times, sulfide sulfur assays, and gold dissolutions from Table 9, and corresponding data from the batch autoclave tests from Table 10 are summarized in Table 11. As is evident, the CIL tailings assays decreased in accordance with decreasing residual sulfide sulfur. Between the limits of 0 to 1.4% S= the relationship appears to approximate a straight line with a relatively steep slope, illustrating the importance of minimizing the residual sulfide sulfur content of the autoclave solids in order to free entrapped gold. The data show that for the Betze ore CIL tailings of 0.02 oz Au/ton or less requires a leach feed with less than approximately 0.1% S=.

TABLE 11

The Effects of Autoclave Retention Time on Sulfide Sulfur Oxidation and the Corresponding Gold Dissolutions

| | 100 lb Acid | | | 0 lb Acid | | |
|---|---|---|---|---|---|---|
| Autoclave Time, min | Solids % S= | Oxidation % S= | Dissolution % Au | Solids % S= | Oxidation % S= | Dissolution % Au |
| | | | Pilot Plant Autoclave | | | |
| 0 | 2.08 | 0 | (25)[1] | 2.08 | 0 | (25)[1] |
| 18.8 | 0.21 | 89.9 | 85.3 | 0.76 | 63.5 | 76.3 |
| 37.5 | 0.10 | 95.2 | 91.9 | 0.16 | 92.3 | 91.7 |
| 56.3 | 0.06 | 97.1 | 94.8 | 0.09 | 95.7 | 90.6 |
| 75 | 0.05 | 97.6 | 94.7 | 0.09 | 95.7 | 90.5 |
| | | | Laboratory Batch Autoclave | | | |
| 0 | 2.00 | 0 | 25.1 | 2.00 | 0 | 24.5 |
| 23 | 0.07 | 96.5 | 91.8 | 1.37 | 31.5 | 65.5 |
| 45 | <0.07 | >96 | 91.9 | 1.10 | 45.0 | 72.1 |
| 68 | <0.07 | >96 | 92.8 | 0.77 | 61.5 | 76.6 |
| 90 | 0.08 | 96.0 | 93.7 | 0.77 | 61.5 | 78.5 |

[1]The values in parentheses are approximations based on data from the laboratory batch tests.

Figure 5:
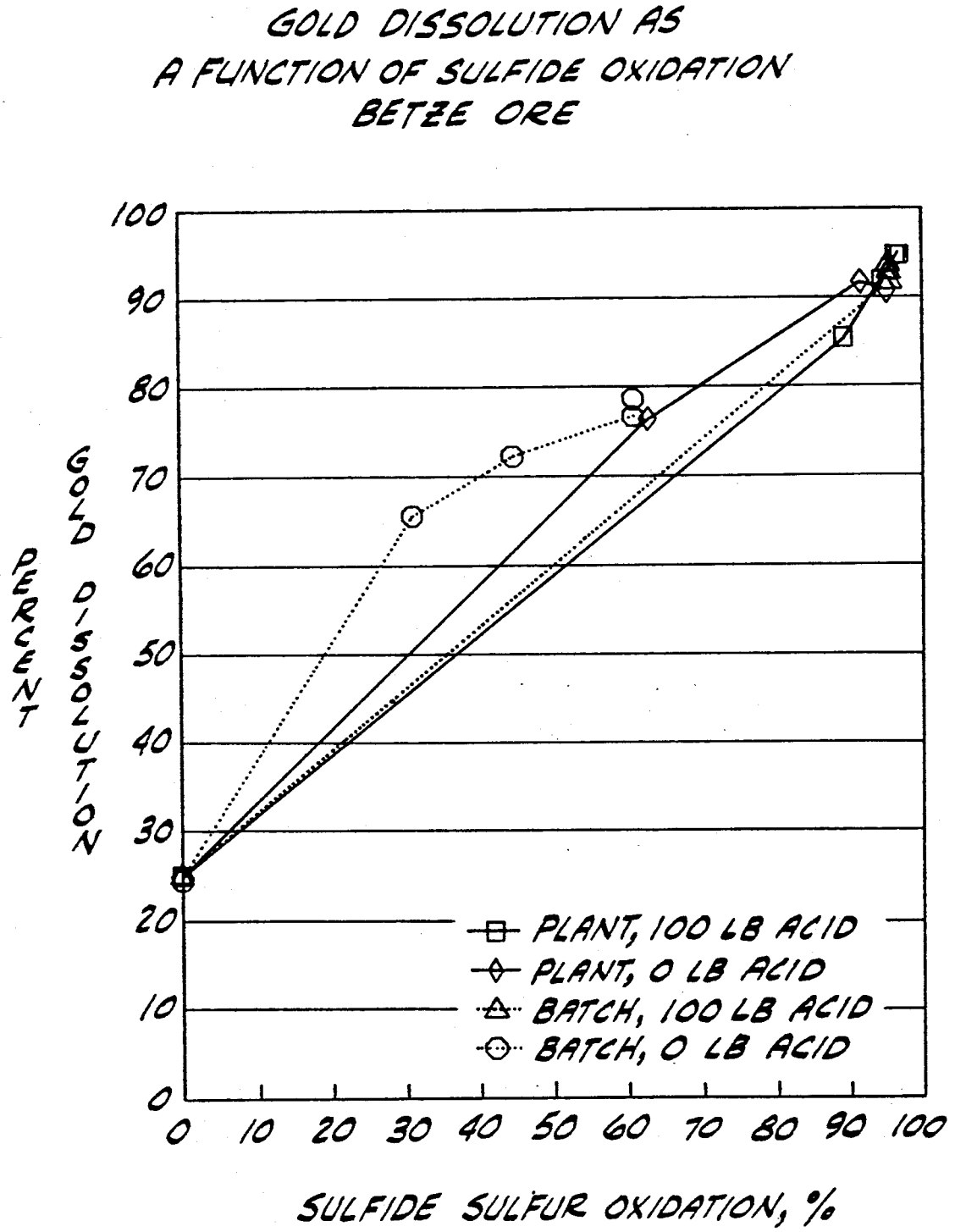
FIG. 5 is a curve indicating, for Betze ore, the relationship between the percent sulfide oxidation and gold dissolution.

A similar relationship for the Betze ore is shown in FIG. 5. The percentage gold dissolutions of the autoclave products are plotted as a function of the percentage of sulfide sulfur oxidation. Data are given for the pilot plant and laboratory batch autoclave solids produced with 100 and 0 lb of acid addition. No data were available for the pilot plant with 50 lb of acid addition.

The data show that gold dissolutions in excess of 90% were achieved only when approximately 92% or greater sulfide sulfur was oxidized. In the case of the batch tests with no acid addition, this criterion was never satisfied and the maximum gold dissolution was only 78.5%. The other batch test with 100 lb of acid addition, and the pilot plant tests with 100 and 0 lb acid addition produced solids with greater than 95% sulfide oxidation and good gold dissolutions.

The data in Table 5 show that the plant autoclave without acid addition produced solids assaying 0.10% S=. This was 95.2% S= oxidation and the pilot plant achieved excellent gold dissolutions; the CIL tailings assayed 0.016 oz Au/ton with 91.8% gold dissolution.

Figure 6:
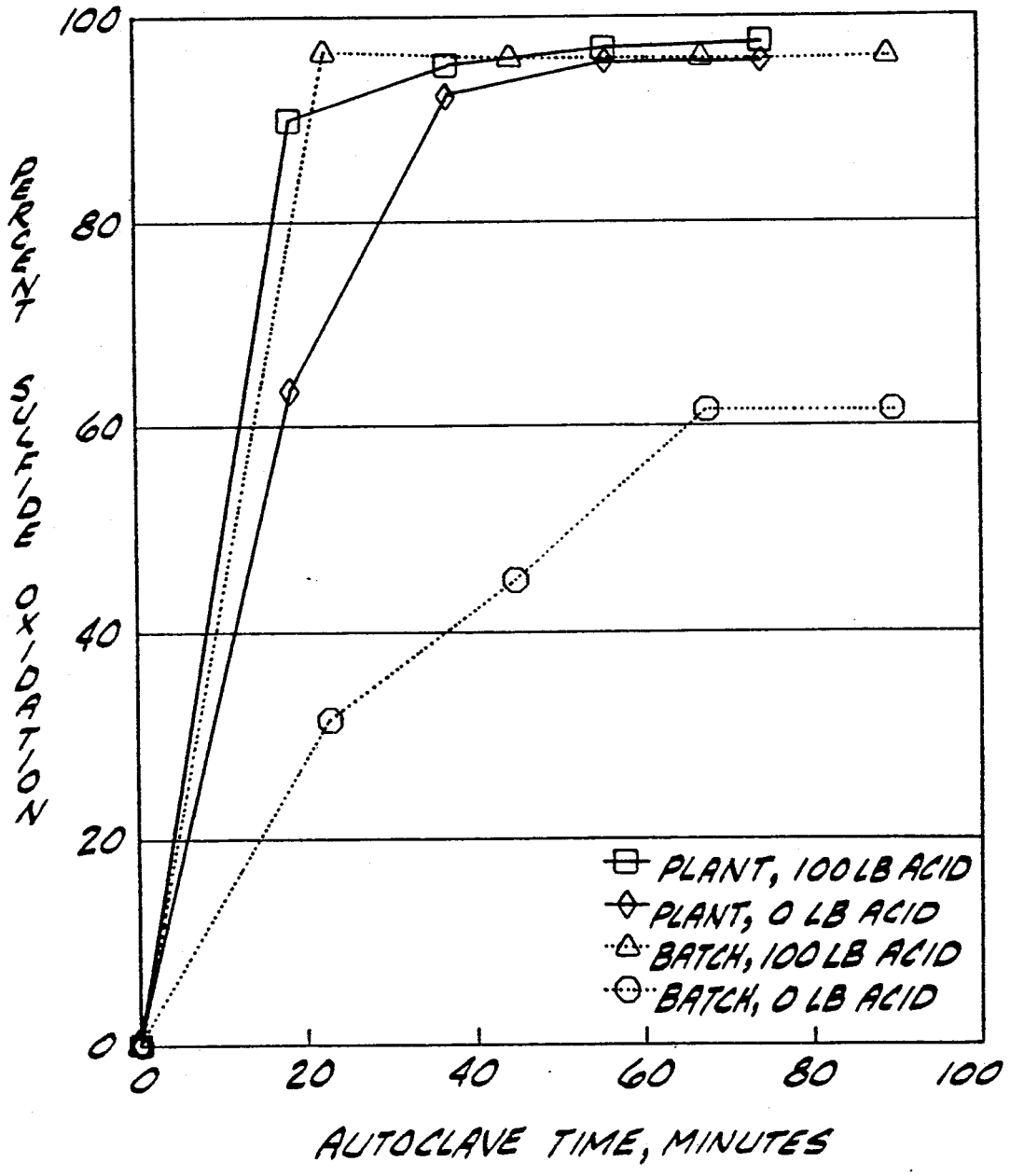
FIG. 6 is a curve indicating, for Betze ore, the relationship between the percent sulfide oxidation and autoclave time.

In FIG. 6 the sulfide sulfur oxidation of the Betze ore is shown as a function of the autoclave retention time for both the pilot plant and laboratory batch autoclave tests. The batch and plant tests with 100 lb acid addition correlate well and show that 90% of the sulfide sulfur was oxidized within the first 30 minutes for the batch test and approximately after 40 minutes for the continuous autoclave. The plant test with 0 lb of acid addition shows a slightly slower oxidation rate, but 92% oxidation was achieved after approximately 45 to 50 minutes. By comparison, the oxidation rate for the batch test without acid was significantly decreased due to the lack of free acid.

In view of the above, it will be seen that the several objects of the invention are achieved and other advantageous results attained.

As various changes could be made in the above process without departing from the scope of the invention, it is intended that all matter contained in the above description or shown in the accompanying drawings shall be interpreted as illustrative and not in a limiting sense.

What is claimed is:

1. In a process for the recovery of gold from a refractory auriferous ore containing sulfide sulfur, which ore may contain natural carbonate, wherein a slurry of the ore is oxidized with oxygen gas under pressure in the presence of sulfuric acid, the oxidized slurry is neutralized, the neutralized slurry is cyanidized to leach gold therefrom, and gold is recovered from the resultant leachate, and wherein the rate at which sulfuric acid is added to the ore slurry is controlled so that, after a startup phase, the amount of sulfuric acid added to the ore slurry is sufficient to insure oxidation of that portion of the sulfide sulfur in the ore which will allow recovery, by cyanide leaching, of at least about 80% of the gold in the ore, the improvement which comprises: cooling the oxidized slurry and passing the cooled slurry directly to a neutralization operation wherein the slurry is neutralized with a base which forms a substantially insoluble salt on neutralization with sulfuric acid.

2. In a process of claim 1 wherein the amount of sulfuric acid mixed with the ore slurry, after the startup phase, is equal to or less than 50% of the stoichiometric equivalent of the natural carbonate in the ore.

3. In a process of claim 1 wherein the base is lime.

4. In a process of claim 2 wherein air is sparged into the slurry during the neutralization operation.

5. In a process of claim 2 wherein the oxidized slurry leaving the pressure oxidation step is cooled by flashing steam from said slurry.

6. In a process of claim 4 wherein the ore slurry is heated with the steam flashed from the oxidized slurry.

7. In a process of claim 4 wherein the oxidized slurry is further cooled by indirect heat exchange with a cooling water stream.

8. In a process of claim 6 wherein indirect heat exchange is effected by passing the oxidized slurry through a shell and tube heat exchanger.

9. In a process of claim 1 wherein the amount of sulfuric acid mixed with the ore slurry is sufficient to oxidize 50–95% of the sulfide in the ore and the ore slurry has a solids content of at least about 30% by weight, the oxidation of the slurry is conducted in an autoclave at a temperature of between about 180° and about 225° C., a total pressure of between about 275 and about 490 pisa, an oxygen partial pressure of at least about 25 psia for a period of at least 60 minutes, and the sulfuric acid concentration of the oxidized slurry is less than about 25 gpl.

10. In a process of claim 9 wherein the oxidized slurry is passed directly to a neutralization operation and is neutralized with lime.

11. In a process of claim 10 wherein air is sparged into the slurry during the neutralization operation.

12. In a process of claim 10 wherein the oxidized slurry leaving the pressure oxidation step is cooled prior to neutralization.

13. In a process of claim 12 wherein cooling is effected by flashing steam from the oxidized slurry and the ore slurry is heated with the steam flashed from said slurry.

14. In a process of claim 9 wherein the autoclave is a horizontal autoclave.

15. In a process of claim 1 wherein the slurry of ore which is oxidized contains pyrite concentrates which have been blended with the ore.

* * * * *

UNITED STATES PATENT AND TRADEMARK OFFICE

CERTIFICATE OF CORRECTION

PATENT NO. : 5,071,477

DATED : December 10, 1991

INVENTOR(S) : Kenneth G. Thomas

It is certified that error appears in the above-identified patent and that said Letters Patent is hereby corrected as shown below:

Column 11, line 11, "after Sulfur, % sulfide" in the first column it should read ---2.07---.

Column 14, line 44, "0.10% 32 should read ---0.10%S=---.

Signed and Sealed this

Thirtieth Day of March, 1993

*Attest:*

STEPHEN G. KUNIN

*Attesting Officer*

*Acting Commissioner of Patents and Trademarks*